United States Patent [19]

Marulic et al.

[11] 3,995,398

[45] Dec. 7, 1976

[54] OPERATING MECHANISM FOR DOUBLE SLIDING DOORS

[75] Inventors: Walter J. Marulic, Gary; Ronald W. Marsh, Michigan City, both of Ind.

[73] Assignee: Pullman Incorporated, Chicago, Ill.

[22] Filed: Mar. 1, 1976

[21] Appl. No.: 662,302

[52] U.S. Cl. ..... 49/168; 49/218; 49/449

[51] Int. Cl.[2] ..... E05D 15/48; E05D 15/10

[58] Field of Search ..... 49/370, 220, 218, 219, 49/168, 163, 449

[56] References Cited

UNITED STATES PATENTS

| | | | |
|---|---|---|---|
| 1,586,266 | 5/1926 | Powell | 49/370 X |
| 3,179,984 | 4/1965 | Bailey | 49/220 |
| 3,245,125 | 4/1966 | Madland | 49/220 |
| 3,750,335 | 8/1973 | Marsh | 49/220 |
| 3,816,965 | 6/1974 | Nagy | 49/220 |
| 3,913,267 | 10/1975 | Knippel et al. | 49/220 |

*Primary Examiner*—Philip C. Kannan
*Attorney, Agent, or Firm*—Richard J. Myers

[57] ABSTRACT

A double door installation for a railway box car includes a lever and locking bolt mechanism for one of the doors. The lever is moved to slide the locking bolt which in an unlocked position interconnects both doors by means of a latch arrangement for conjoint movement.

10 Claims, 5 Drawing Figures

FIG. 1
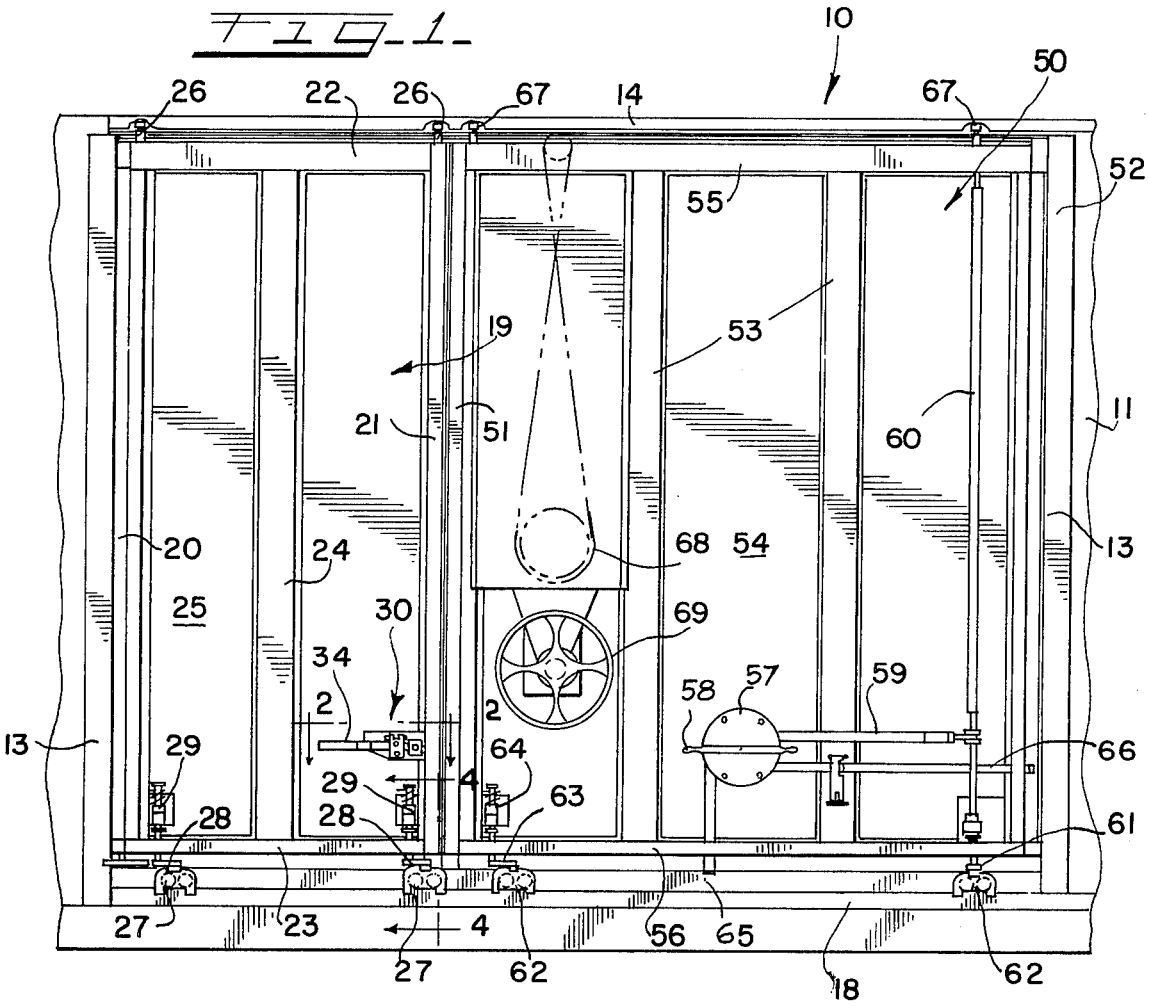
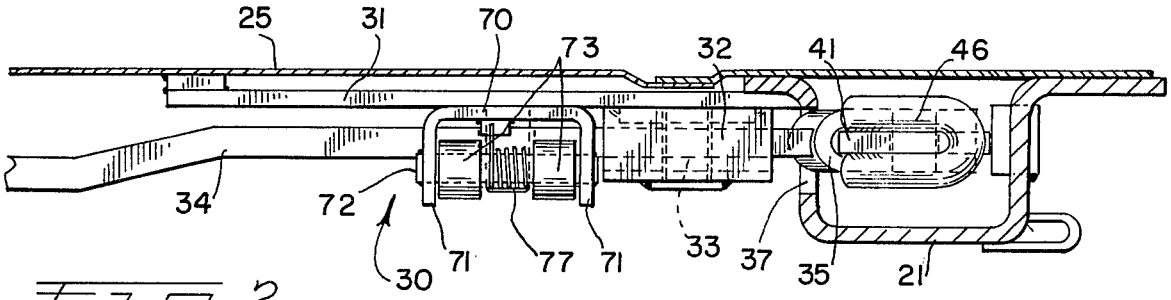
FIG. 2

FIG. 3
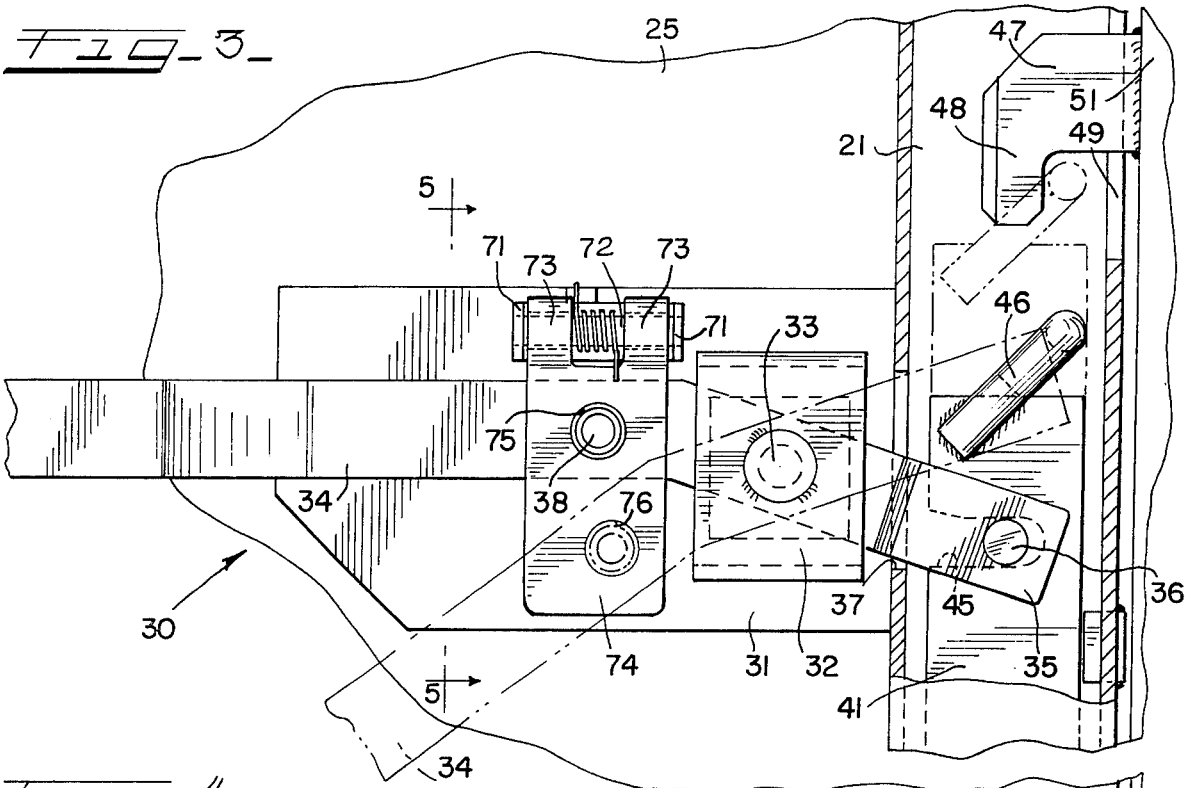
FIG. 4
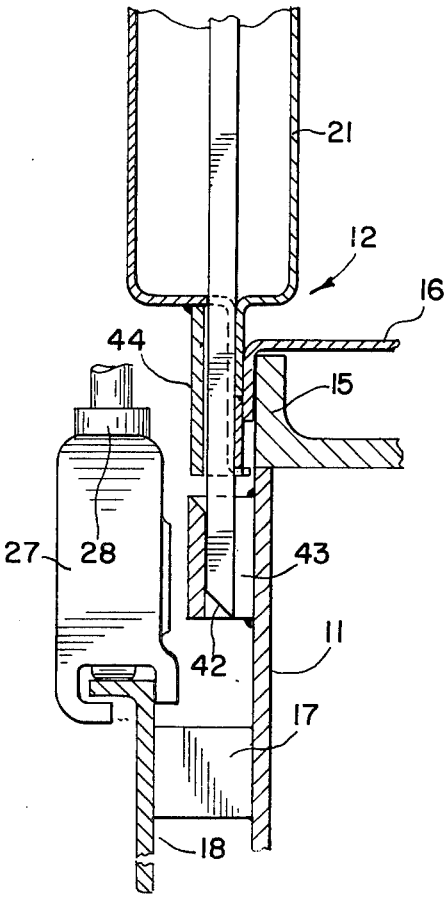
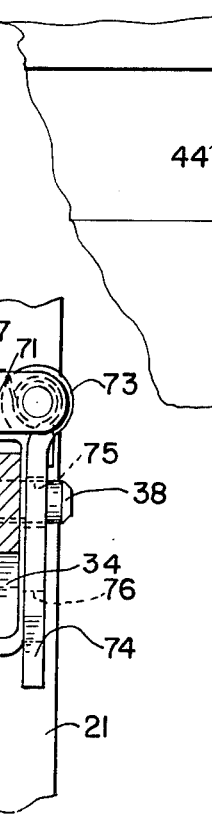
FIG. 5

OPERATING MECHANISM FOR DOUBLE SLIDING DOORS

BACKGROUND OF THE INVENTION

1. Field of Invention

The invention involves sliding doors or a combination of sliding and plug doors of a type generally utilized on railway box cars.

2. Description of the Prior Art

Prior art patents pertaining to double door installations are well known in the art and generally include individually operable bolt type locking mechanisms.

The present invention relates to an improved mechanism wherein the bolt locking mechanism at one of the doors includes means interconnecting the doors for conjoint movement when the doors are both in an unlocked position.

SUMMARY OF THE INVENTION

The present invention is applied to a double door arrangement for an enlarged door opening wherein one of the doors may be moved to one side of the car, or both doors may be moved together to increase the size of the opening. One of the doors is provided with a locking mechanism of a type described in U.S. Pat. No. 3,750,335 issued Aug. 7, 1973. The latter door is movable laterally outwardly and slides to one side of the opening by means of a force multiplying mechanism disclosed in U.S. Pat. No. 3,816,965.

The other door includes a lever and bolt arrangement which locks the door to the door frame at the opening. A bolt is movable to a non-lock raised position and includes a latch element which in the non-lock position engages a hook shaped latch on the second door whereby both doors are connected for conjoint movement.

BRIEF DESCRIPTION OF THE DRAWINGS

FIG. 1 is a side elevational view of a box car door arrangement;

FIG. 2 is a cross sectional view taken substantially along the line 2—2 of FIG. 1;

FIG. 3 is an enlarged side elevational view of a door locking arrangement disclosing lock and unlock positions;

FIG. 4 is a cross sectional view taken along the line 4—4 of FIG. 1; and FIG. 5 is a cross sectional view taken along the line 5—5 of FIG. 3.

DESCRIPTION OF THE PREFERRED EMBODIMENT

Referring now particularly to FIG. 1, a box car door 10 includes a side wall 11 having a door opening 12 formed by side frame members 13, a top header 14, and a lower threshhold member 15. A floor is designated at 16, as shown in FIG. 4. Brackets 17 support a door track 18.

A first sliding door 19 includes side vertical door frame members 20 and 21 connected to an upper door frame member 22 and lower door frame member 23. A central support member 24 is connected to door sheathing 25. The upper portion of the door 19 is guided on the top header by roller guides 26. The door 19 is supported on the track 18 by means of roller assemblies 27 connected to conventional crank arms 28 in turn supported on swivel assemblies 29 connected to the door 19.

A door locking assembly for the door 19 is designated at 30 and includes a mounting bracket 31 supported on the sheathing 25. A lever support bracket 32 is connected to the bracket 31 and includes a pivot member 33 which partially supports a hand lever 34. The end of the lever 34 is provided with a U-shaped yoke 35 which supports a pin 36 extending therethrough.

The yoke 35 extends through a slot 37 provided in the right hand frame member 21. A lock pin 38 is connected to the lever 34 and projects horizontally outwardly thereof as shown in FIG. 5.

A locking bar 41 is vertically reciprocal in the side frame member 21, and includes a lowered tapered end 42, which is adapted to engage a keeper or latch bracket 43 in locking relation. The keeper 43 is mounted on the side wall member 11. A guide member 44 connected to the frame member 21 guides the tapered end 42 into the keeper 43. As best shown in FIG. 3, an open end slot 45 is provided in the locking bar 41, and is engaged by the pin 36 for reciprocating said bar vertically within the frame member 21. A U-shaped hook bracket 46 is connected to the upper end of the bar 41 and adapted to interconnect with a hook bracket 47 having a hook end 48 engaged by the bracket 46. The bracket 48 projects through an opeing 49 of the frame member 21 and is connected to a vertical side frame member 51 of a door 50. The door 50 also includes another side frame member 52, and vertical stabilizer beams 53 supporting door sheathing 54. Upper and lower frame members 55 and 56 respectively are connected to the frame members 51 and 52.

A door operating mechanism is generally designated at 57 and includes a rotatable handle 58 connected to linkage 59 in turn connected to a pipe 60. This type of mechanism is disclosed in detail in U.S. Pat. No. 3,816,965 and in other prior art. A crank arm 61 connected to the pipe 60 is in turn pivotally connected to a roller assembly 62. The other end of the door 50 is supported by means of a crank arm 63 on a swivel assembly 64, the crank arm 63 being also supported on a roller assembly 62, said assemblies being supported on the track 18.

Locking bolts 65 and 66 are movable into and out of locking relation with the door frame by means of the mechanism 57. The upper end of the pipe 60 is provided with guide rollers 67 supported on the header 14. The opposite end of the door is also provided with similar guide rollers 67.

A force multiplying mechanism for moving the door in sliding relation to the door opening is designated at 68. This mechanism is more specifically described in U.S. Pat. No. 3,816,965 and includes a handwheel 69 which upon rotation moves the door 50 to one side of the door opening 12.

Referring now particularly to FIGS. 2, 3 and 5, a latch bracket 70 includes flanges 71 on which a hinge pin 72 is secured. Hinge loop 73 suppported on the hinge pin 72 is integral with latch plate 74 having vertically offset openings 75 and 76 which are adapted to be engaged by the lock pin 38. A spring 77 suitably supported on the hinge pin 72 biases the latch plate 74 to a locking position.

OPERATION

The doors 19 and 50 in FIG. 1 are shown in closed and locked positions. In this position the door 19 has its locking bolt or bar 41 in locking engagement with the keeper. the lock pin 38 is in engagement with the lever 34 to lock the same against pivoting action thereby securing the bar 41 in lock position.

At the selection of the operator the door 50 may be moved upon rotation of the handle 58 of the mechanism 57. The bolts 65–66 are initially moved to an open position and upon further rotation of the handle 58 the linkage 59 moves the pipe 60, and crank arms to move one edge of the door laterally out of the door opening. By actuation of the mechanism 68, the door is now moved to an open position to one side of the door opening.

In the event if it is desired to then open the door 19, it is a simple matter to lift up the latch 74, rotate the lever 34 to withdraw the locking bar 41 from lock position whereupon the door 19 can then be moved to one side of the door opening.

At the selection of the operator who may wish to move both doors 19 and 50 simultaneously to an open position, this accomplished by first rotating the lever 34 from the solid line position of FIG. 3 to the broken line position. This movement permits the eye bracket 46 to engage the hook 48 of the bracket 47 in interconnecting engagement. The latch 74 is moved into the engaged position of the pin 38 with the opening 76 and the doors 19 and 50 are now interlocked so that they can be moved in concert to an open position.

To close the doors and again lock them in the position of FIG. 1 the operation is reversed.

What is claimed is:

1. A vehicle having a door opening, first and second doors positioned side by side in said opening, said doors being slideably supported on said vehicle for movement from a position closing said opening to an open position to one side of said opening, said second door having a bolt locking member engageable with a portion of said vehicle to lock said second door in said opening, and an operating member on said second door connected to said locking member for moving the same between locking and unlocking positions, the improvement of;

a door locking mechanism for said first door comprising;

a second bolt connected to said first door for relative sliding movement, a keeper on said vehicle engageable by said second bolt for locking said first door, an actuating lever pivotally connected to said first door, means connecting said lever to said second bolt for reciprocating the same, a latch member on said second door, and a latch element on said second bolt engageable with said latch member to interconnect said doors in the unlocked position of said bolt.

2. The invention in accordance with claim 1, said latch member comprising a hook and said latch element comprising a hook.

3. The invention in accordance with claim 1, said first door including a vertical hollow frame member, said second bolt being positioned within said frame member for vertical reciprocation.

4. The invention in accordance with claim 3, said frame member having an opening, and said latch member in the closed position of said doors extending through said opening within said hollow frame member.

5. The invention in accordance with claim 1, said means connecting said lever to said second bolt including respectively a projecting pivot member, on said lever and an elongated slot on said second bolt.

6. The invention in accordance with claim 1, including a second latch member on said first door for maintaining said second bolt in said locked position.

7. The invention in accordance with claim 6, said second latch member including a hinge bracket connected to said first door, a latch plate hingedly connected to said hinge bracket to overlie said lever, and means connecting said latch plate to said lever to retain said lever and second bolt in an unlocking or locking position.

8. The invention in accordance with claim 7, said means connecting said latch plate to said lever including a stud on said lever, and a pair of openings on said latch plate selectively engageable in said openings.

9. The invention is accordance with claim 8, including biasing means urging said latch to said connected position relative to said lever.

10. The invention in accordance with claim 8, said openings being vertically off-set relative to one another.

* * * * *